US009038854B2

(12) United States Patent
Brügmann

(10) Patent No.: US 9,038,854 B2
(45) Date of Patent: May 26, 2015

(54) PRODUCT DISTRIBUTION DEVICE

(75) Inventor: Lars Brügmann, Hagen (DE)

(73) Assignee: Dirk A. Brugmann Kunststoff-Verarbeitung GmbH & Co. KG (DE)

( * ) Notice: Subject to any disclaimer, the term of this patent is extended or adjusted under 35 U.S.C. 154(b) by 162 days.

(21) Appl. No.: 13/530,337

(22) Filed: Jun. 22, 2012

(65) Prior Publication Data

US 2013/0026176 A1 Jan. 31, 2013

(30) Foreign Application Priority Data

Jul. 27, 2011 (DE) ..... 10 2011 052 167

(51) Int. Cl.

| | |
|---|---|
| ***A47F 1/04*** | (2006.01) |
| ***A47F 1/12*** | (2006.01) |
| ***G07F 11/30*** | (2006.01) |
| ***G07F 11/42*** | (2006.01) |

(52) U.S. Cl.

CPC ..... *A47F 1/126* (2013.01); *G07F 11/30* (2013.01); *G07F 11/42* (2013.01)

(58) Field of Classification Search

USPC ..... 221/69, 87, 89, 90, 92, 123, 130, 131, 221/151, 152, 154, 208, 247–249, 268, 271, 221/276, 279

See application file for complete search history.

(56) References Cited

U.S. PATENT DOCUMENTS

| | | | | |
|---|---|---|---|---|
| 2,460,396 | A * | 2/1949 | Rifkin | 221/279 |
| 2,522,896 | A * | 9/1950 | Rifkin et al. | 221/260 |
| 2,784,872 | A * | 3/1957 | Lux | 221/207 |
| 4,336,892 | A * | 6/1982 | Cox et al. | 221/125 |
| 8,047,385 | B2 * | 11/2011 | Hardy | 211/59.3 |
| 8,485,391 | B2 * | 7/2013 | Vlastakis et al. | 221/15 |
| 2004/0060944 | A1 * | 4/2004 | Gervasi | 221/263 |
| 2008/0245811 | A1 * | 10/2008 | Colelli et al. | 221/90 |
| 2010/0017025 | A1 * | 1/2010 | Lockwood et al. | 700/240 |
| 2010/0059469 | A1 * | 3/2010 | Mason et al. | 211/162 |
| 2012/0000869 | A1 * | 1/2012 | Hardy | 211/59.3 |
| 2013/0193156 | A1 * | 8/2013 | Kaleta et al. | 221/7 |

FOREIGN PATENT DOCUMENTS

| | | | |
|---|---|---|---|
| DE | 298 20 417 U1 | 12/1999 | G07F 11/02 |
| EP | 0 979 628 B1 | 2/2000 | A47F 1/12 |
| EP | 1 834 549 A1 | 9/2007 | A47F 4/00 |

OTHER PUBLICATIONS

European Search Report for European Patent Application No. EP 12 16 7663.9, Sep. 6, 2012.

* cited by examiner

*Primary Examiner* — Gene Crawford

*Assistant Examiner* — Kelvin L Randall, Jr.

(74) *Attorney, Agent, or Firm* — Kusner & Jaffe

(57) ABSTRACT

A product distribution device for accommodating at least one row of products with products which can be arranged in succession on a support surface of a product guide element in a receiving space with the following features: at least one door for stocking the receiving space with the products, guide means which are guided along the support surface in one conveyance direction F for advancing the products in the conveyance direction F, a catch element which can be switched between one catch position of the conveyance means and one conveyance position of the conveyance means.

9 Claims, 8 Drawing Sheets

Close
7
K
23n
20s
22
20r
F
24

22s
22b
22n

21

PRODUCT DISTRIBUTION DEVICE

FIELD OF INVENTION

This invention relates to a product distribution device for accommodating at least one row of products with products which can be arranged in succession on a support surface in a receiving space.

BACKGROUND OF INVENTION

To store a stock of products including product packaging and for presentation of the packages to customers, especially in self-service businesses, especially for expensive products, there are often at least largely closed product distribution devices by which on the one hand product presentation in a pleasing manner is to be possible, on the other hand however theft of large amounts is to be prevented. On the other hand, the restocking cycles will be reduced by a large number of products being able to be accommodated in the product distribution device.

In these at least largely closed product distribution devices there is simultaneously the problem that the removal of products is made difficult by for example the customer having to trigger security mechanisms, such as for example a door or a slide, for removal of a product. At the same time there is the problem of space-saving installation of the product distribution devices into existing shelf systems.

Moreover secure holding of the products at different fill levels as well as an optimum arrangement of products on the front are to be guaranteed.

The object of this invention is therefore to provide a product distribution device whose handling, especially when products are being removed, is configured to be as simple as possible, but at the same time also secure, and which ensures an optimum arrangement of the products in the receiving space.

This object is achieved with the features of the claims. Advantageous developments of the invention are given in the dependent claims. All combinations of at least two of the features given in the specification, the claims and/or the figures also fall within the framework of the invention. For given value ranges values which lie within the indicated boundaries will be considered disclosed as boundary values and will be claimed in any combination.

SUMMARY OF INVENTION

The invention is based on the idea of making the product distribution device with a catch element which can be easily and reliable switched or actuated in spite of the at least largely closed receiving space. Here the product distribution device is largely closed/closable, aside from a closable door and a removal opening which is accessible even in stacking of the product distribution device for sequential distribution of the product of each product row which is the frontmost product at the time. Products mean especially packaged products. Closed product distribution devices are designed and suitable especially for products with a high sale value and small outside dimensions, especially razor blades, printer inks for inkjet printers, etc. The product distribution device can be especially advantageously built by the catch element being made separately from the support surface, especially as a single component. Here it is furthermore advantageous if the catch element has a length which corresponds roughly to the length of the receiving space or of the support surface, but especially smaller width and height, preferably smaller by at least half.

Because the product distribution device as claimed in the invention is made to be stackable, a plurality of product distribution devices can be accommodated on much less shelf volume. By the door of the product distribution device being attached with a pivoting capacity to one front edge of the bottom, the filling of the product distribution device is easily enabled even for several product distribution devices which are stacked on top of one another. It is especially advantageous if the door in the closed position is made to be lockable, especially by a lock. In this way the removal of a plurality of product packages in a short time can be made difficult or prevented.

According to one advantageous embodiment, to switch the catch element by opening and closing of the door which can be locked especially by a lock, there are actuation means which are located especially on an inside wall which is pointed toward the receiving space, preferably on one pivoting axis of the door. In this way the mechanism according to the invention is most easily actuated automatically at the instant at which the catch position is needed, specifically when the door is opened (therefore when restocking the products). It is especially advantageous here if the catch element is made such that it functions independently of the fill level of the receiving space, especially of the respective product row, preferably separately for each product row, even more preferably independently of the adjacent product row.

According to another advantageous embodiment of the invention it is provided that the catch element is made as a catch rail which is located especially underneath the product guide element for sliding guidance of the product guide element along the conveyance direction F, especially with one degree of freedom for moving the product guide element orthogonally to the support surface. This construction is on the one hand durable and long-lived and on the other it can be implemented with few components and on an extremely narrow space, especially in combination with an oblique arrangement of the support surface.

An automatic action principle, especially also when resetting the catch element from the catch position into the conveyance position, preferably when closing the door, according to the invention can be especially easily implemented in that the catch element is spring-loaded relative to the product guide element, especially in the conveyance direction F, by a spring element which is attached especially to the catch element.

To prevent jamming and for long-lived operation of the product distribution device and simple manipulation it is provided that the catch element can be moved between the catch position and the conveyance position opposite the product guide element along a guideway which runs obliquely to the conveyance direction F, especially curved, and which is guided by guide means which are provided especially on the catch element and the product guide element.

In a development of this invention it is provided according to one embodiment that the support surface which is provided especially with conveyance means for especially automatic conveyance of the products of the product row in one conveyance direction F in the direction of the door is made as a ramp with a ramp pitch R greater than 3 degrees, especially greater than 5 degrees in the conveyance direction F, especially relative to the bottom of the receiving space. In this way the products can be pushed in the direction of the door without tilting or upsetting in the product distribution device, and by the angling of the door in relation to the ramp the frontmost product can be tilted toward the door so that only the frontmost product is accessible via the removal opening and the other products of the row of products are not accessible. Removal of several packages of one product row at one time is thus effectively prevented.

By there being one removal opening between the closed door and one front edge of a cover of the receiving space for sequential distribution of the product of the product row which is located nearest the door, the product distribution device can be made especially to be stackable and simple and at the same time reliable removal of the product of each product row assigned to the removal opening, which product is frontmost at the time, is possible.

To the extent the removal opening is made such that only one individual, specifically the frontmost product of the product row can be removed, the security of the product distribution device against theft is greatly enhanced, especially if there are noise generating means which generate noise when the products are conveyed. It is especially advantageous for further enhancement of security when by tilting the frontmost product on one front end of the support surface, especially of the ramp, toward the door the distance of the other products of the product row to the removal opening is increased.

In another advantageous embodiment of the invention, it is provided that the door in the closed position is angled forward by an angle $W_1$ greater than 5 degrees, especially greater than 10 degrees relative to an orthogonal line $O_1$ to the support surface of the product row. The angle $W_1$ is especially smaller than 90 degrees, preferably smaller than 45 degrees. By angling the door relative to the support surface several functions are performed, specifically especially simple accessibility of the removal opening and the possibility of a horizontal arrangement of the product distribution device on a shelf so that the product distribution devices can be arranged on standard shelves via corresponding shelf fixing means.

Here it is moreover advantageous if according to another advantageous embodiment of the invention the door in the closed position relative to an orthogonal line $O_2$ to the bottom is angled forward by an angle $W_2$ greater than 5 degrees, especially greater than 10 degrees, especially the angle $W_1$ being greater than $W_2$.

Optimum stacking of the product distribution device is enabled by one stacking surface of the cover being made corresponding to one stacking surface of the bottom, especially having the same dimensions, the product distribution devices being made such that when stacking identical product distribution devices all removal openings remain accessible for removal of the products.

To the extent a length $L_D$ of the cover essentially agrees with a length $L_B$ of the bottom in the conveyance direction F, in a stacking of a plurality of product distribution devices a uniform and flush arrangement of the doors or front edges of the product distribution device is obtained. The length $L_D$ and the length $L_B$ are each defined by shelf fixing up to one front edge of the cover or of the bottom.

By the actuating means being arranged such that the catch element, especially on one face side of the catch element, is actuated when the door is being closed, the operation of the product distribution device is again facilitated so that even untrained individuals can easily manage operation of the distribution device.

Other advantages, features and details of the invention will become apparent from the following description of preferred exemplary embodiments and using the drawings.

DETAILED DESCRIPTION OF PREFERRED EMBODIMENTS

The same components or components with the same function are identified with the same reference numbers in the figures.

Figure 1:
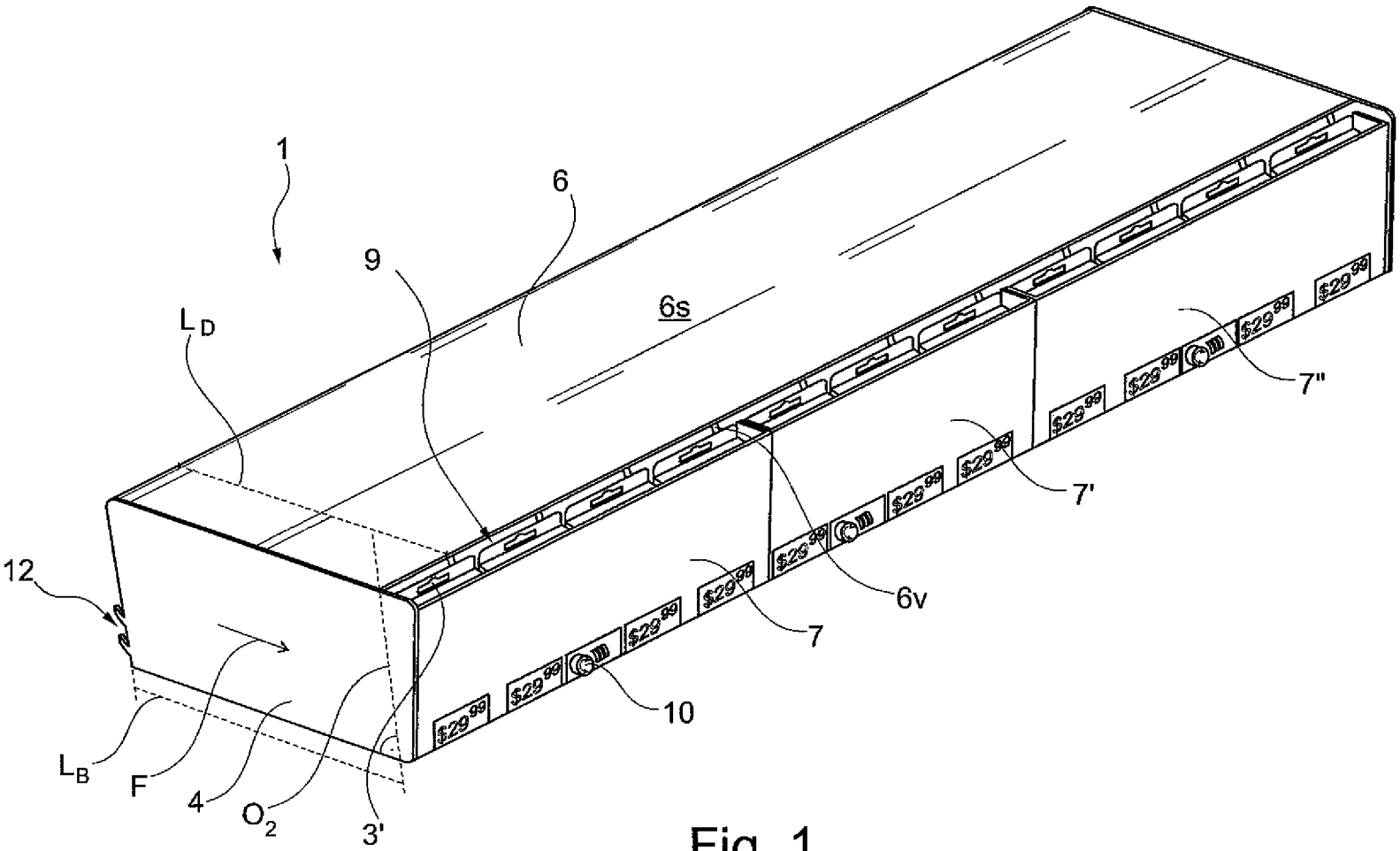
FIG. 1 shows a perspective view of one embodiment of the product distribution device as claimed in the invention.
Figure 2A:
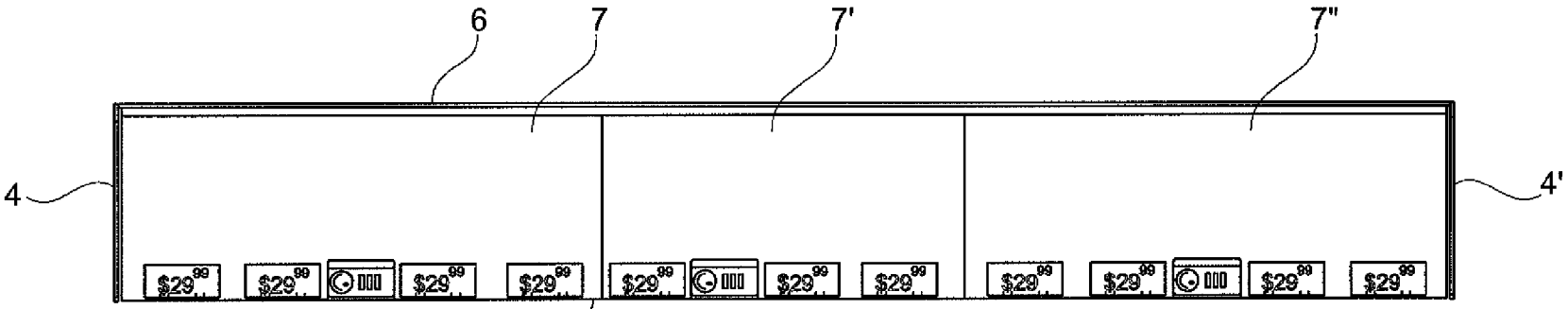
FIG. 2*a* shows a front view of the embodiment according to the invention according to FIG. 1.
Figure 2B:
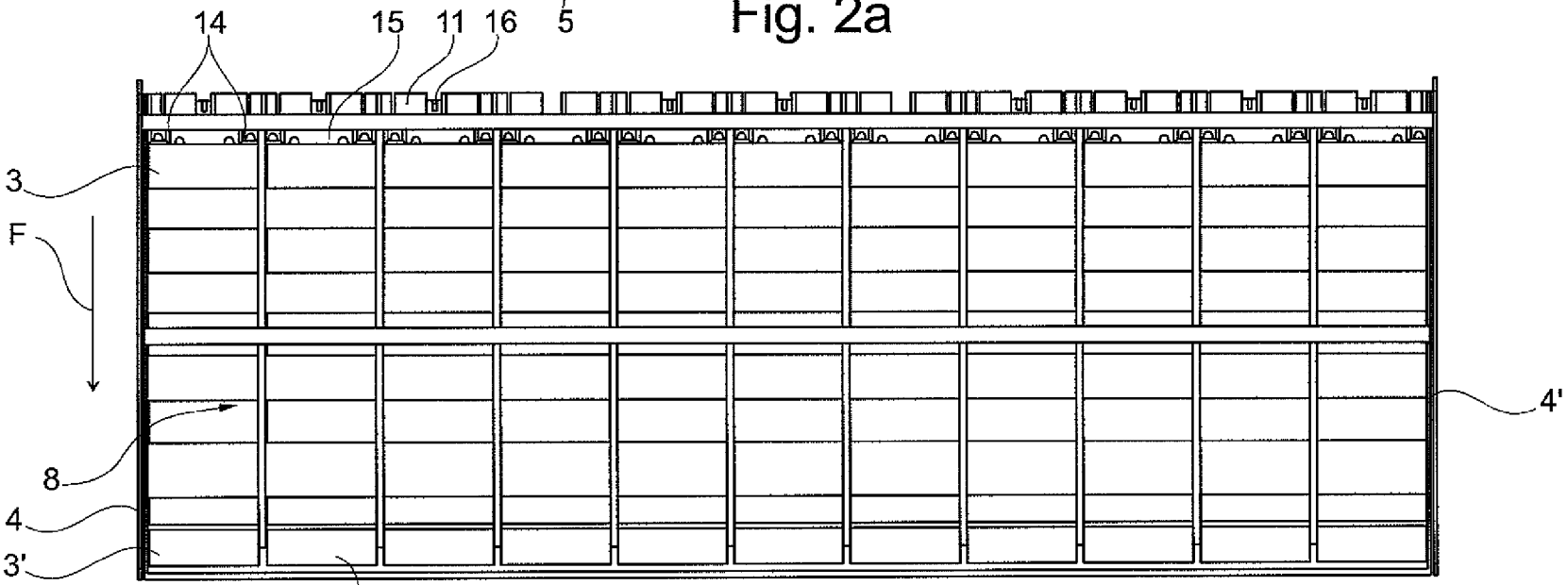
FIG. 2*b* shows a plan view of the embodiment according to the invention according to FIG. 1 without a cover.
Figure 3:
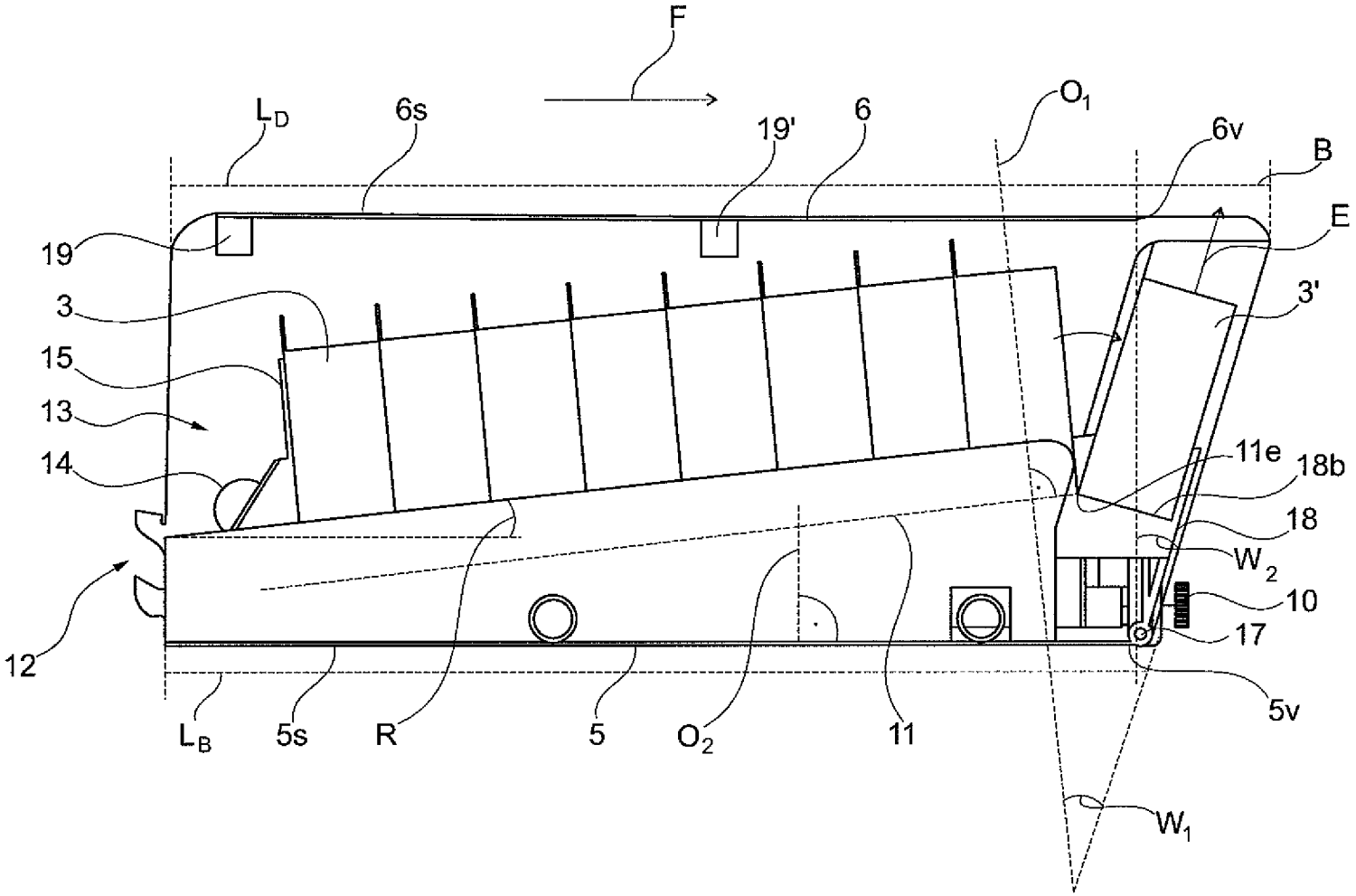
FIG. 3 shows a cutaway side view of the embodiment according to the invention according to FIG. 1.

FIG. 1 shows a stackable product distribution device which, aside from a removal opening 9, is formed by a bottom 5, two side walls 4, 4' which are arranged laterally opposite on the bottom 5 and a cover 6 which is located on the other end of the side walls 4, 4' as well as doors 7, 7', 7" which are provided on one front side of the product distribution device for opening and closing of a receiving space 8 which can be especially subdivided. On the back of the product distribution device there can optionally be a rear wall, and by attaching the product distribution device to a shelf by shelf fixing means 12 the receiving space 8 which is formed by the bottom 5, the side walls 4, 4', the cover 6 and the doors 7, 7', 7" can be closed so that the shelf or a rear wall of the shelf or a wall on which the shelf is standing forms the rear wall of the product distribution device.

In the receiving space 8 there can be a plurality of products 3, 3' in rows 2 of products, for each row 2 of products for conveyance of the products 3, 3' in the direction of the respective door 7, 7', 7" there being especially automatic conveyance means 13. The conveyance means 13 can be formed by a pusher 15 which is loaded with a spring 14. The pusher 15 is guided to be able to slide along a guide groove 16 which is provided in a support surface 11 for support of the products 3, 3'. To retard the conveyance of the products in the conveyance direction F there can be retarding means 24 which are made to act against the spring force which is acting by the spring 14 on the pusher 15, the retarding force being smaller than the spring force acting on the pusher.

Several identical product distribution devices can be stacked on top of one another, and the bottom 5 with its stacking surface 5*s* which forms the entire lower surface of the bottom 5 can be stacked on a stacking surface 6*s* of a cover 6 of another product distribution device. The stacking surface 5*s*, 6*s*, of each product distribution device are arranged corresponding to one another and along one orthogonal line $O_2$ flush with one another. In particular, in the conveyance direction F, lengths $L_D$ of the cover 6 and $L_B$ of the bottom 5 essentially agree, in any case aside from rounded edges. The cover 6 is reinforced by reinforcing elements 19, 19' which run transversely to the conveyance direction so that the stability is ensured even when several product distribution devices are stacked. Advantageously the reinforcing elements 19, 19' are located in the rear area of the receiving space since here there is room due to the oblique arrangement of the support surface 11.

In the mounted state of the product distribution device on a shelf via shelf fixing means 12 one front edge 5*v* of the bottom 5 and one front edge 6*v* of the cover 6 have an essentially identical distance to the shelf. The front edges 5*v*, 6*v* of several product distribution devices which are stacked on top of one another thus form a common merchandise presentation surface, the doors 7, 7', 7" in the closed state and the removal opening 9 which runs from the front edge 5*v* to the doors 7, 7', 7" projecting from the merchandise presentation surface. Because the doors 7, 7', 7" run obliquely relative to the merchandise presentation surface from the removal opening 9 to the front edge 5*v* of the bottom 5, on the one hand an aesthetically pleasing picture and simple accessibility in the grasping range of the customer for the removal of the frontmost product 3' from each product row 2 and simple restocking of emptied product rows 2 by opening the corresponding closable door 7, 7', 7" are enabled. It is especially advantageous if the doors 7, 7', 7" are made at least partially transparent so that the products 3' can be recognized through them at least in part, preferably in full.

The doors 7, 7', 7" are coupled on the front edge 6*v* by a pivot bearing 17 on the bottom 5 for opening/closing.

In the closed state, the doors 7, 7', 7" are angled relative to an orthogonal line $O_2$ to the bottom 5 or the stack surface 5*s* by an angle $W_2$ greater than 5 degrees, in the exemplary embodiment 15 degrees. The angle $W_2$ together with the height of the product distribution device is responsible for a width B of the removal opening 9. The greater the angle $W_2$ and/or the taller the product distribution device, the greater the width B of the removal opening 9.

When the frontmost product 3' of one product row 2 is being removed via the removal opening 9, the entire product row 2 is pushed by the conveyance means 13 in the conveyance direction F. In this way the now frontmost product 3' is pushed beyond the front end 11*e* of the support surface 11 and tilted forward until the now frontmost product 3' adjoins an L-shaped removal holder 18.

The L-shaped removal holder has a bottom surface 18*b* which runs orthogonally to one removal direction E and one stop surface 18*a* which is angled thereto and which runs especially parallel to the removal direction E, and the stop surface can alternatively be the doors 7, 7', 7" themselves.

The support surface 11 is provided as a ramp with a ramp pitch R greater than 3 degrees, here 8 degrees, in the conveyance direction F. This yields a more dramatic tilt angle of the frontmost product 3' relative to the other products 3 of the product row 2 so that only the frontmost product 3' can be removed through the removal opening 9. With reference to an orthogonal line $O_1$ to the support surface 11, the angle $W_1$ of the closed door 7, 7', 7" arises which is greater than the angle $W_2$, in this case by 23 degrees, therefore $R+W_2$.

Figure 4:
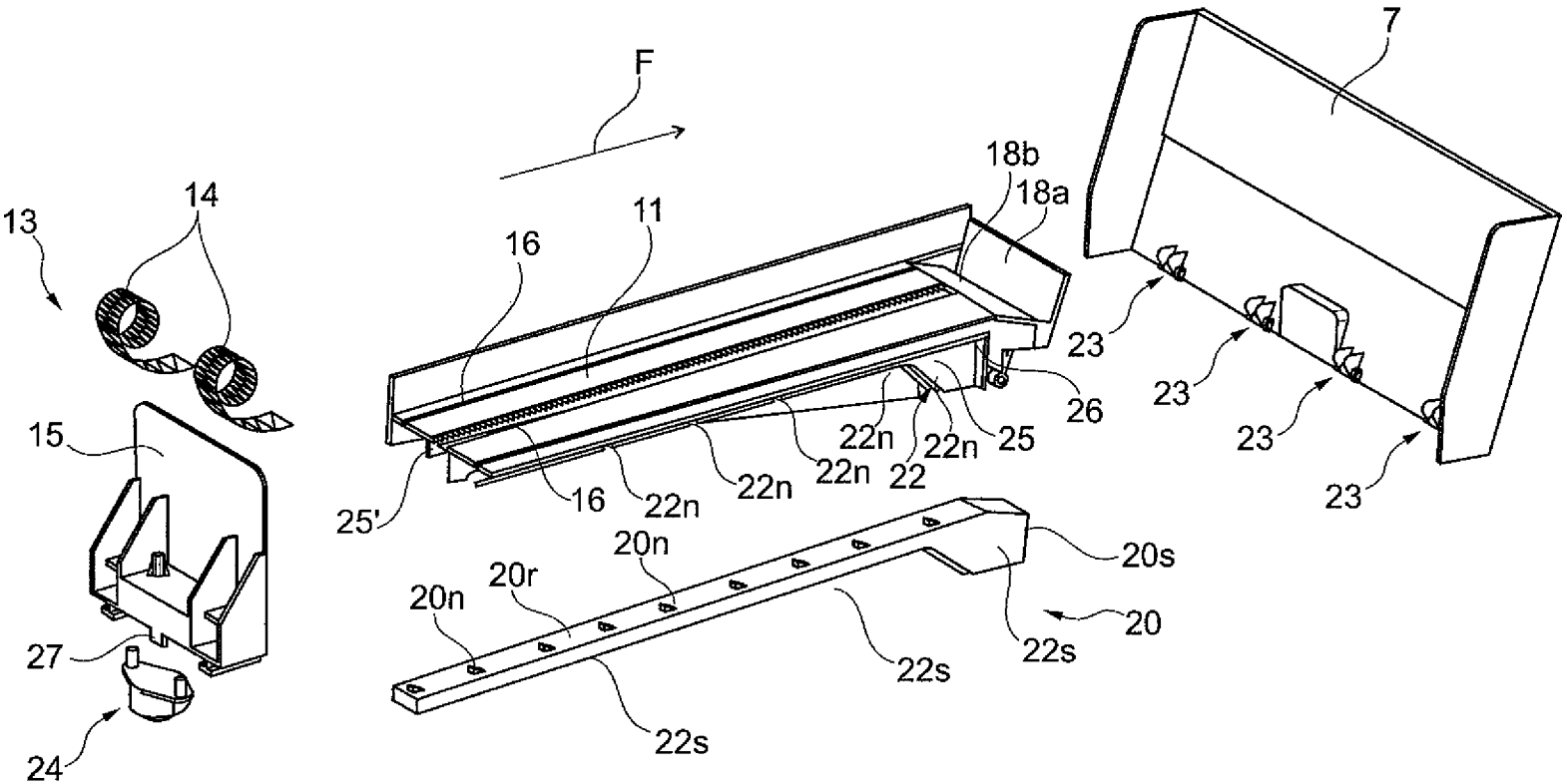
FIG. 4 shows an exploded perspective of the individual components of the embodiment according to the invention according to FIG. 1, FIGS. 5*a* to 5*c* show a cutaway side view of the embodiment according to the invention according to FIG. 1 in a closed position of the door with two extract enlargements (FIGS. 5*b* and 5*c*)

FIG. 4 shows a catch element 20 which can be switched between a catch position of the conveyance means 13 and a conveyance position of the conveyance means 13 and which is important for this invention. The catch element 20 is located underneath the support surface 11 and is guided to slide along two guide walls 25, 25' by arrangement between the two guide walls 25, 25' in the conveyance direction F. The catch element 20 can move orthogonally to the support surface 11, a guideway 22*b* being dictated by guide means 22.

The guide means 22 consist of several guide grooves 22*n* which are arranged distributed along the guide walls 25, 25' as well as corresponding opposite guide grooves 22*n*'. Furthermore the guide means 22 corresponding to the guide grooves 22*n*, 22*n*' comprise guide pins 22*s* which are located on opposite side walls 20*w*, 20*w*' and along which the guide grooves 22*n*, 22*n*' are guided.

Figures 5A, 5B, 5C:
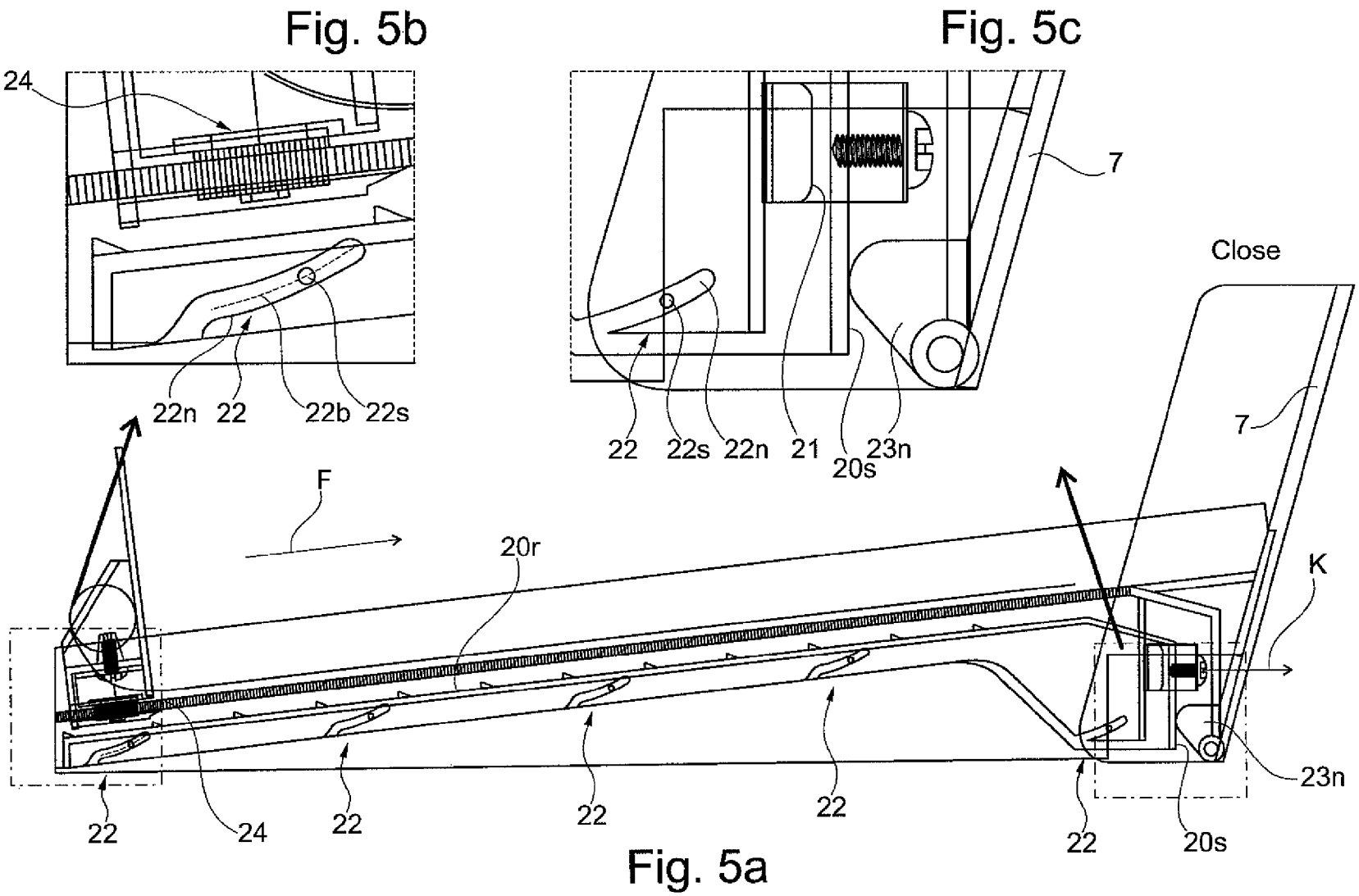
Figures 6A, 6B, 6C:
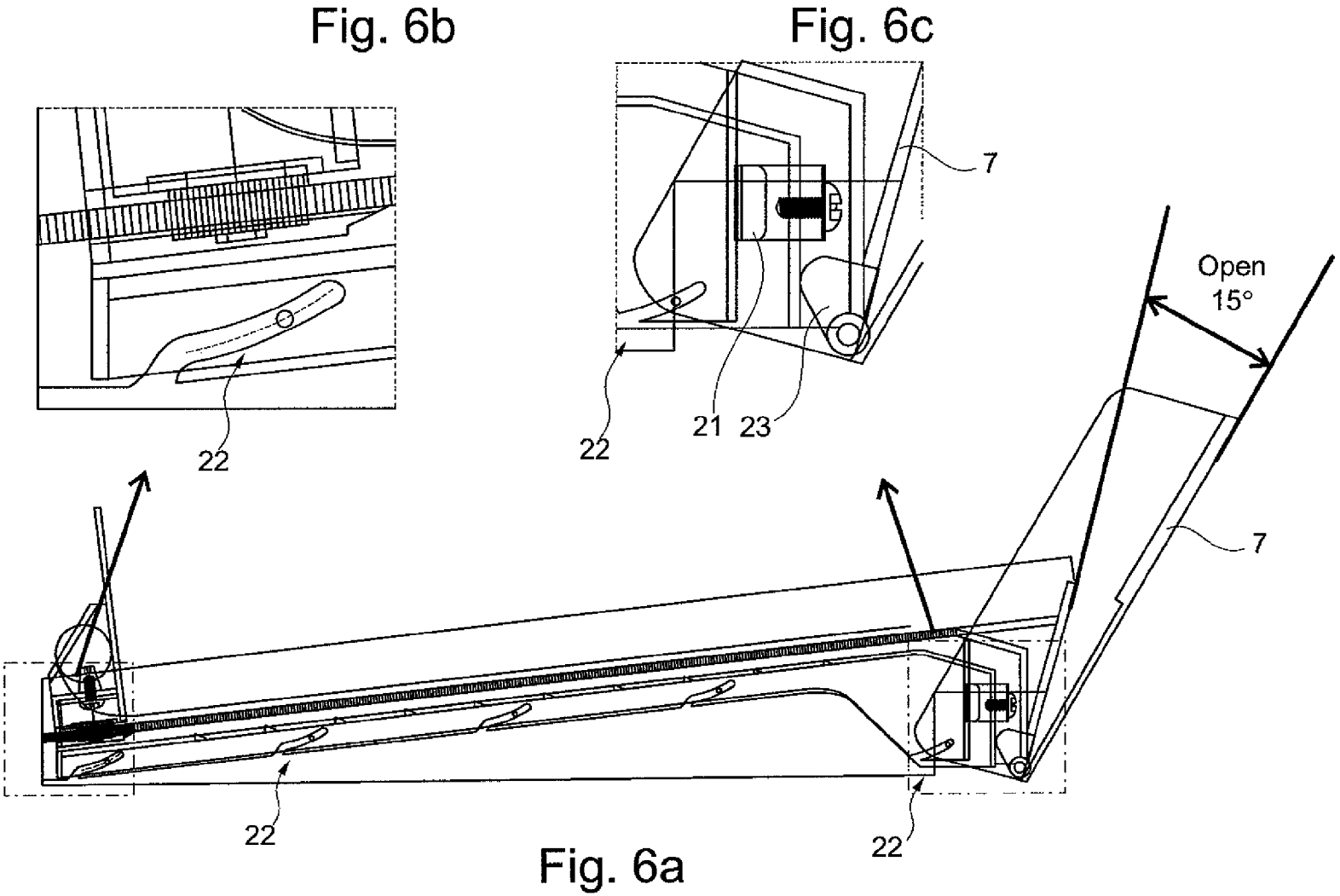
FIGS. 6*a* to 6*c* show a cutaway side view of the embodiment according to the invention according to FIG. 1 in a door position which has been opened by 15° with two extract enlargements (FIGS. 6*b* and 6*c*)

A guideway 22*b* which is thus dictated by the guide means 22, as shown in FIGS. 5*a* to 8*c*, runs obliquely to the conveyance direction F of the products 3, see especially FIG. 5*b*. The guideway 22*b* runs curved in the illustrated embodiment.

The catch element 20 on one face side 20*s* which is the front side in the conveyance direction F has a spring element 21 which is attached to the face side 20*s*. The spring element 21 applies a spring force K to the catch element 20 relative to a stop surface 26 which is attached to the support surface 11. Thus the catch elements 20 tries to slide along the guideway 22*b* in the conveyance direction F relative to the support surface 11. In this way a catch surface 20*r* of the catch element 20, which surface points toward the support surface 11, approaches the conveyance means 13 when the catch element 20 moves along the guideway in the conveyance direction F.

The relative position of the catch element 20 in the product distribution device in which the support surface 11 is fixed is determined by actuating means 23. The actuating means 23 as actuating projections 23*n* in the region of the pivot bearings 17 are attached to the doors 7, 7', 7" so that the actuating means 23 with the pivoting movement of the doors 7, 7', 7" likewise execute a corresponding pivoting motion.

The actuating projections 23*n* limit the movement of the catch element 20 in the conveyance direction F by their adjoining the face side 20*s* of the catch element 20 in the closed state of the door 7, 7', 7". In the closed position of the doors 7, 7', 7" the catch element 20 is in one conveyance position of the conveyance means 13 by a distance of the catch surface 20*r* relative to the support surface 11 being maximum by the guide means.

In the conveyance position defined hereby the conveyance means 13 are not blocked and conveyance of the products 3 in the conveyance direction F is possible (braked by the retarding means 24).

As soon as one of the doors 7, 7', 7" is opened and it executes a pivoting motion around the pivot bearing 17, the actuating means 23 are also pivoted in the conveyance direction F away from the stop surface 26. In this way the catch element 20 on which the spring element 21 acts is moved along the guideway 22*b* in the conveyance direction F (see different opening positions according to FIGS. 6*a*, 6*b*, 6*c*, 7*a*, 7*b*, 7*c*, 8*a*, 8*b*, 8*c*).

The distance of the catch surface 20*r* to the support surface 11 and thus also to the conveyance means 13 which is guided to slide relative to the support surface 11 is reduced by the guideways' 22*b* running obliquely. As soon as the movement of the catch element 20 in the conveyance direction is stopped (in the exemplary embodiment in the position shown in FIGS. 7*a* to 7*c*) the catch element 20 is in one catch position in which the conveyance means 13 are blocked by the catch element 20 in the conveyance direction F. For blocking of the conveyance means 13, along the catch surface 20*r* there are catch projections 20*n* distributed so that along the catch surface 20*r* different engagement positions of the conveyance means 13 arise. For this purpose the conveyance means 13 have a catch projection 27 which projects through the support surface 11 in the direction of the catch element 20. The catch projection 27 is arranged such that it extends between one guide groove 16 and between the guide side 25. In the catch position of the conveyance means 13 relative to the catch element 20 the catch projection 27, depending on the position of the conveyance means 13 along one support surface 11, strikes one of the catch projections 20*n* (see FIG. 7*b* and FIG. 8*b*) so that the conveyance is stopped (catch position).

Figures 7A, 7B, 7C:
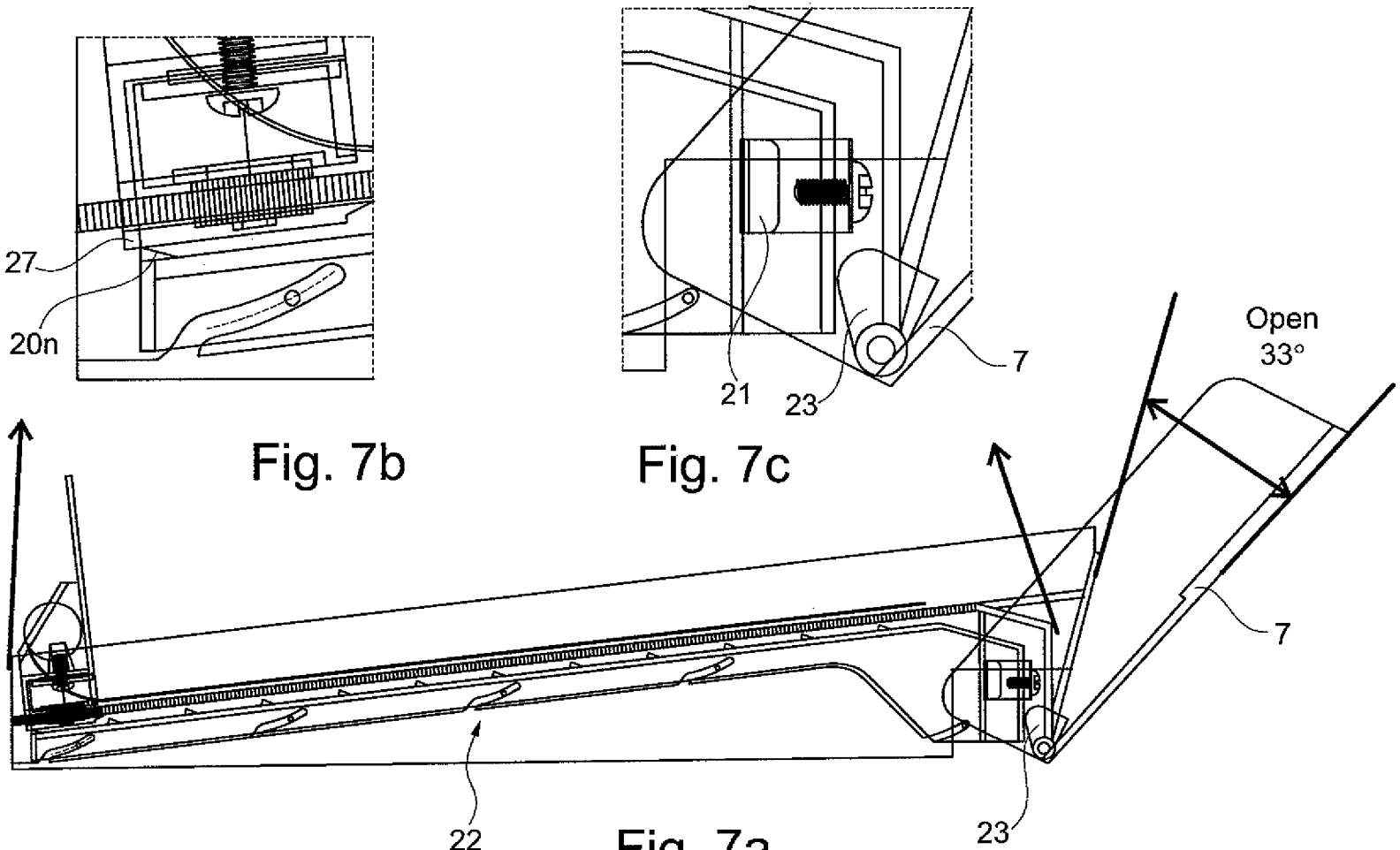
FIGS. 7*a* to 7*c* show a cutaway side view of the embodiment according to the invention according to FIG. 1 in a door position which has been opened by 33° with two extract enlargements (FIGS. 7*b* and 7*c*)
Figures 8A, 8B, 8C:
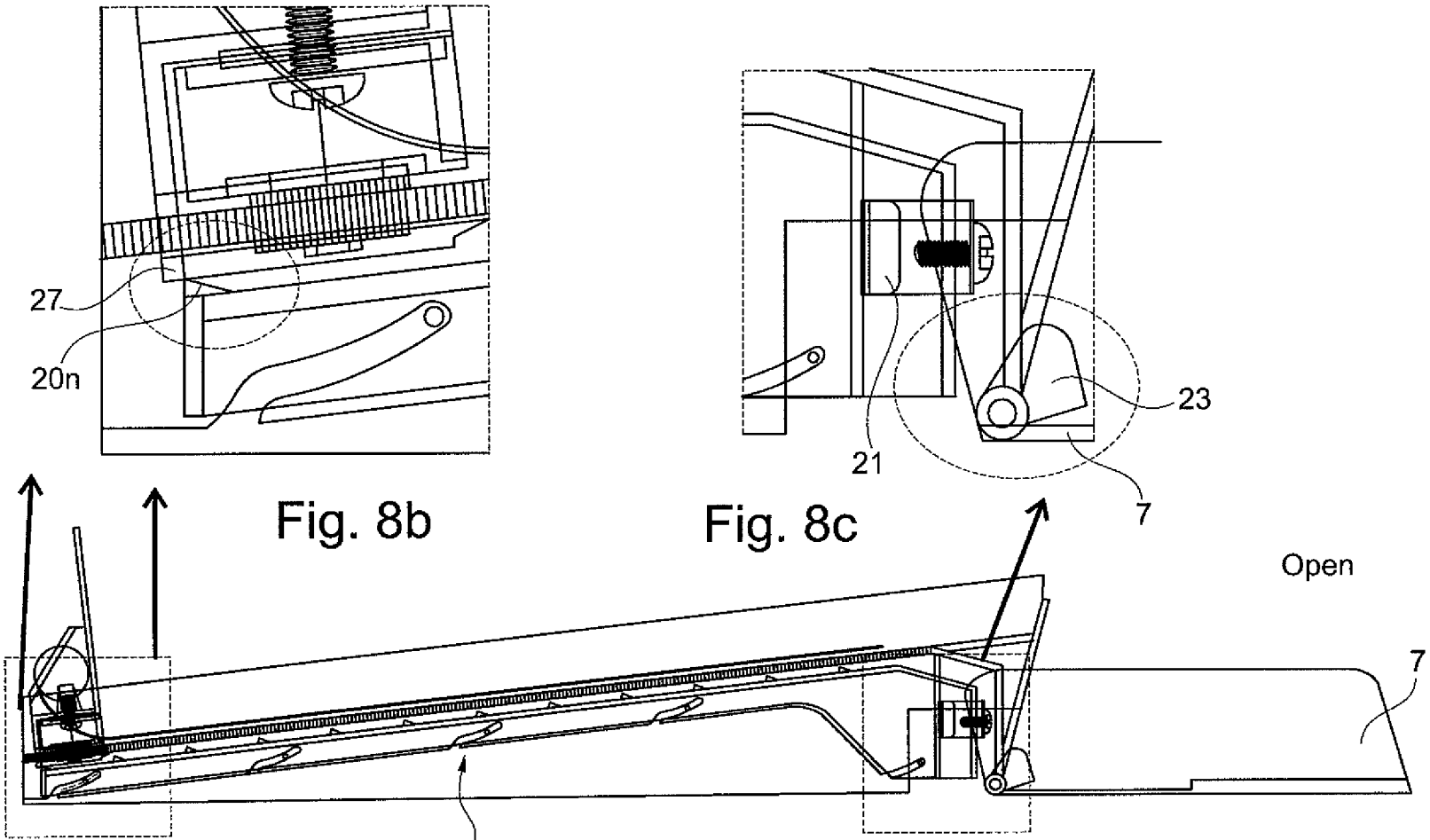
FIGS. 8*a* to 8*c* show a cutaway side view of the embodiment according to the invention according to FIG. 1 in an opened door position (filling position) with two extract enlargements (FIGS. 8*b* and 8*c*).

So that the catch element 20 does not project through the support surface 11 and thus would raise the products 3, 3', the guide means 22 are made such that in the catch position shown in FIGS. 7*b* and 8*b* there is a limiting of the movement caused by the spring element 21 along the guideway 22*b*. This is achieved in that the guide pins 22*s*, 22*s'* strike the end of the guide grooves 22*n*, 22*n'* as soon as the catch position is reached.

Having described the invention, the following is claimed:

1. A product distribution device for accommodating at least one row of products, said device including:

a housing defining a receiving space, the housing having a front upper edge extending between side walls of the housing;

a product guide element disposed within the receiving space, the product guide element having a support surface for receiving the products thereon, wherein the products are aligned along one conveyance direction and the support surface has a pitch greater than 3 degrees in the conveyance direction, at least one door disposed on the housing, the at least one door movable between an open position for stocking the receiving space of the housing with the products and a closed position for allowing sequential distribution of the products from the device, wherein the at least one door is spaced from the front, upper edge of the housing to define a removal opening when the at least one door is in the closed position, the removal opening dimensioned to allow the product to be removed from the device when the at least one door is in the closed position and wherein only a single product disposed next to the at least one door is tilted away from the device when the at least one door is moved from the closed position to the open position, a guide device moveable on the support surface in the conveyance direction, the guide device having a surface for engaging the products to move the products in the conveyance direction, and a catch element disposed below the support surface of the product guide element, the catch element moveable between a catch position and a conveyance, wherein a stop of the catch element extends above the support surface of the product guide element for hindering movement of the guide device in the conveyance direction when the catch element is in the catch position and the stop of the catch element is disposed below the support surface of the product guide element when the catch element is in the conveyance position.

2. The product distribution device as claimed in claim 1, wherein the product distribution device further includes:

an actuation means located on an inside wall of the at least one door, the actuation means having a surface engaging the catch element for moving the catch element between the catch position and the conveyance position as the at least one door is moved between the open position and the closed position.

3. The product distribution device as claimed in claim 1, wherein the catch element is a catch rail which is located underneath the product guide element, the product guide element having guides for allowing the catch element to slide in the conveyance direction.

4. The product distribution device as claimed in claim 1, wherein the device further includes a spring element that engages the catch element for biasing the catch element into the catch position.

5. The product distribution device as claimed in claim 1, wherein the product guide element includes at least one guide groove formed therein to define a guideway and the catch element includes at least one guide pin moveable within the guide groove, wherein the catch element moves between the catch position and the conveyance position as the at least one guide pin moves along the guideway.

6. The product distribution device as claimed in claim 1, wherein the at least one door is angled forward greater than 5 degrees relative to a line orthogonal to the support surface of the product guide element when the at least one door is in the closed position.

7. The product distribution device as claimed in claim 6, wherein the at least one door is angled forward greater than 5 degrees relative to a line orthogonal to the bottom of the product distribution device when the door is in the closed position.

8. The product distribution device as claimed in claim 1, wherein the door is pivotally attached to one front edge of the bottom of the product distribution device.

9. The product distribution device as claimed in claim 2, wherein the actuating means is actuated when the door is moved to the closed position.

* * * * *